United States Patent [19]

Wagner

[11] 4,133,662

[45] Jan. 9, 1979

[54] PRODUCTION OF HIGH PRESSURE OXYGEN

[75] Inventor: Norbert Wagner, Schlederloh, Wolfratshausen, Germany

[73] Assignee: Linde Aktiengesellschaft, Wiesbaden, Germany

[21] Appl. No.: 751,453

[22] Filed: Dec. 16, 1976

[30] Foreign Application Priority Data

Dec. 19, 1975 [DE] Fed. Rep. of Germany ..... 2557453

[51] Int. Cl.[2] ..... F25J 3/04

[52] U.S. Cl. ..... 62/13; 62/30; 62/39

[58] Field of Search ..... 62/29, 30, 13–15, 62/41, 39, 38

[56] References Cited

U.S. PATENT DOCUMENTS

| | | | |
|---|---|---|---|
| 2,918,802 | 12/1959 | Grunberg | 62/41 |
| 3,079,759 | 3/1963 | Schilling | 62/41 |
| 3,086,371 | 4/1963 | Schilling et al. | 62/41 |
| 3,110,155 | 11/1963 | Schuftan | 62/30 |
| 3,236,059 | 2/1966 | Bernstein | 62/30 |
| 3,251,190 | 5/1966 | Seidel | 62/30 |
| 3,258,930 | 7/1966 | Jakob | 62/39 |
| 3,327,488 | 6/1967 | Pervier | 62/39 |

*Primary Examiner*—Norman Yudkoff
*Attorney, Agent, or Firm*—Millen & White

[57] ABSTRACT

For the production of high pressure $O_2$ by two-stage low-temperature rectification wherein prior to said rectification the air is subjected to a preliminary purification step, compressed, and cooled by heat exchange with separation products, the improvement of splitting the air feed prior to cooling; further compressing a split minor portion of the air feed; at least partially liquefying said further compressed air feed in a condenser-evaporator in indirect heat exchange contact with vaporizing oxygen product, the condenser-evaporator being at least functional separate and distinct from the rectification column and under a higher pressure on the oxygen side than the sump of the low pressure stage of the rectification column; passing resultant at least partially liquefied air into the high pressure stage of the rectification column; cooling a split major portion of the air feed without further compressing; and passing resultant cooled major portion of the air feed into the high pressure stage of the rectification column.

11 Claims, 2 Drawing Figures

PRODUCTION OF HIGH PRESSURE OXYGEN

BACKGROUND OF THE INVENTION

This invention relates to a system for the separation of air by two-stage low-temperature rectification wherein the air is subjected to a preliminary purification step, compressed, and cooled by heat exchange with separation products.

In such processes, the oxygen product of the low pressure stage is generally evaporated in indirect heat exchange contact with condensing nitrogen of the high pressure stage. The relationship of the pressures of the two rectification stages is based on the requirement that the condensation temperature of the nitrogen must be somewhat above the vaporization temperature of the oxygen. Due to this thermodynamic correlation between the pressure conditions in both stages, the pressure of the high pressure stage is clearly dependent on the desired pressure of the products withdrawn from the low pressure stage. Consequently, if it is desired to obtain the separation products at higher pressures, the pressure of the high pressure stage must also be raised, and, therefore, the entire air feed must be compressed to a higher pressure. This results in high operating costs, particularly in the case of large-scale plants. For details of this conventional air separation process, attention is invited to, for example, U.S. Pat. No. 3,070,966 (M. Ruhemann and L. Putman) and U.S. Pat. No. 3,447,331 (K. Smith, BOC).

SUMMARY OF THE INVENTION

A principal object of this invention is to develop a generally improved air separation process, and especially for the production of relatively high pressure oxygen. (By relatively high pressure is meant about at least 1.6 bars, preferably at least 1.8 bars, and particularly in the range of about 1.7 to 3.6 bars.)

Upon further study of the specification and appended claims, further objects and advantages of this invention will become apparent to those skilled in the art.

To attain these objectives, a process is provided wherein a portion, e.g. 18 to 34, preferably 24 to 28% of the feed air is further compressed in a recompressor prior to the cooling thereof and is at least partially liquefied in a condenser-evaporator in heat exchange with evaporating product oxygen before being introduced into the rectifying column.

Generally, the feed air from the main compressor is at a pressure of about 5.8 to 7.8 bars, preferably about 6.2 to 6.8 bars; absolute accordingly, in the recompressor the air is compressed from such pressures to the pressure necessary to obtain the desired pressure of oxygen product. Thus, the air in the recompressor is usually compressed from the pressure of the main compressor to about a pressure of about 6.5 to 10 bars preferably 7.2 to 8.0 absolute bars. In any case, the recompressor will compress the air incrementally at least 0.7, preferably 1.0 to 2.2 bars.

In the condenser-evaporator, which is at least functionally, if not physically, separate and distinct from the rectification column, the air is usually liquefied to the extent of at least 70%, preferably at least 80%, and particularly in the range of 75 to 100%.

By this invention, the product oxygen can now be obtained under a pressure higher than that of the low pressure stage. This is possible, because according to the invention a portion of the higher-compressed, condensing feed air now yields the heat of vaporization for the oxygen.

The pressure in the oxygen vapor space of the condenser-evaporator can be increased by arranging the condenser-evaporator at a lower level than the sump of the low pressure column, thereby imposing a "column of oxygen" additional pressure on the vapor space. It is likewise possible to provide an increased pressure in the oxygen vapor space of the condenser-evaporator by a liquid pump, with the aid of which the liquid product oxygen is pumped from the sump of the low pressure column into the condenser-evaporator. In general, the pressure in the oxygen vapor space of the condenser-evaporator is maintained at about 0.4 to 2.0, preferably 0.6 to 1.0 bars higher than the pressure in the sump of the low pressure column.

The process of this invention can also be utilized with special advantage in air separation plants containing a compensating stream which is engine-expanded in a turbine. The compensating stream can be nitrogen as well as air. It was found that, in this method, the energy produced at the expansion turbine frequently cannot be exploited economically, since the conversion into electrical energy is economically, since the conversion into electrical energyd is economically ineffecient and unattractive. Therefore, it is particularly advantageous to utilize the mecahnical energy obtained at the expansion turbine directly for the further compression of the portion of the feed air according to this invention. For additional details of processes employing a compensating stream, attention is invited to, for example, R. E. Latimer "Distillation of Air" Chem. Engineering Progress Feb. 1967 p. 35/59

The use of the process of this invention leads to additional advantages, particularly in air separation plants operating with regenerators. Regenerators, as opposed to reversible heat exchangers, are employed on account of their long lifetime and reliable operation. However, they have the disadvantage that the product oxygen must be warmed in very expensive tubular coils within the regenerators. To avoid this disadvantage, it has been proposed to warm the product oxygen agains a portion of the feed air in a separate heat exchanger, but in this case, the air must be cleaned in a molecular sieve system prior to entering the heat exchanger. According to an advantageous further development of the present invention, the recompressed portion of the feed air is now cleansed in a molecular sieve system before being cooled in heat exchange with product oxygen. Due to the fact that the molecular sieve system, as compared to conventional plants, operates under a higher pressure, the efficiency of the adsorption process is increased, resulting in lower operating costs. For additional details of the process employing molecular sieves and a heat exchanger instead of a tubular coil, attention is invited, for example, M. Duckett (Petrocarbon) "Economics of medium-size air separation plants for the owner/operator" Process Engineering Dec. 1973 p. 76/81

BRIEF DESCRIPTION OF THE DRAWINGS

Identical parts carry the same reference numerals in both figures.

DETAILED DESCRIPTION OF PREFERRED EMBODIMENTS

Figure 1:
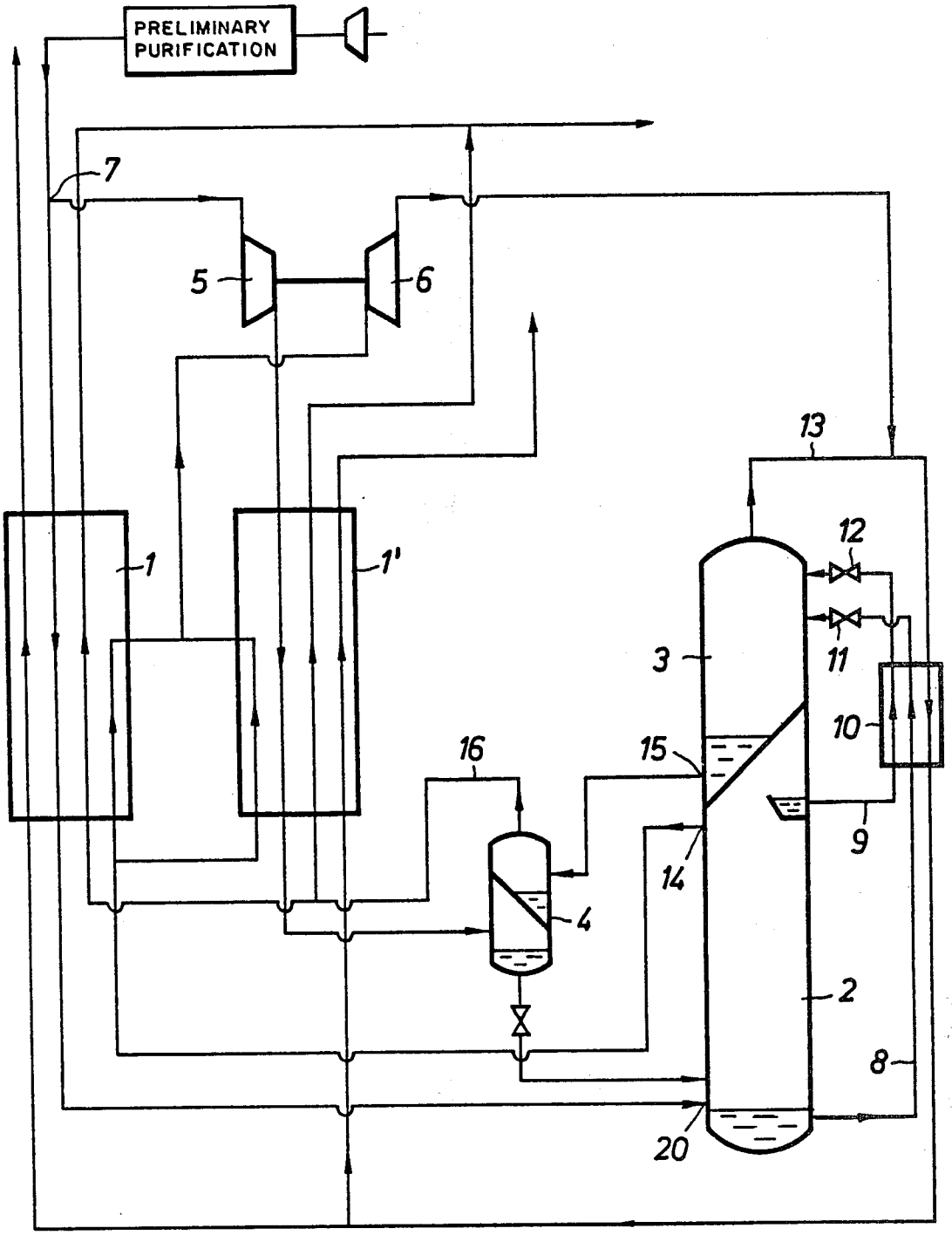
FIG. 1 is a schematic diagram of a preferred embodiment of an air separation plant according to the invention with a reversing exchanger as the primary heat exchanger, wherein nitrogen is utilized as the compensating stream.

A system according to this invention consists of a revex 1 or a pair of regenerators 1", a twin rectifying column consisting of a high pressure column 2 and a low pressure column 3, a condenser-evaporator 4, a recompressor 5, and an expansion turbine 6. The conventional devices for switching the flow paths in the reversing exchanger are not illustrated, since this would obfuscate the drawing. For the same reason, the regenerator pair is shown only as a single heat exchanger, in correspondence with its function.

Preliminary purified and compressed air at a pressure of 6.5 bars is subdivided into two partial streams at point 7 (FIG. 1). The larger (74%) of the two partial streams is cooled in reversing exchanger 1 to 102° K. and introduced into the high pressure column 2 at point 20. Crude fractions of oxygen and nitrogen are withdrawn via conduits 8 and 9, respectively, from the high pressure column 2, cooled in heat exchanger 10, expanded in valves 11 and 12, respectively, and introduced into the low pressure column for purposes of further rectification. Residual gas is withdrawn from the head of the low pressure column 3 via conduit 13; after the residual gas has been warmed in heat exchangers 10 and 1, it leaves the plant. Gaseous nitrogen is withdrawn from the head of the high pressure stage 2 at point 14 and, in order to maintain the desired, small temperature difference, introduced into the reversing exchangers 1 and 1' at the cold ends thereof. Before the heat exchange process is terminated, this stream is again withdrawn from reversing exchangers 1 and 1' and, after engine expansion in turbine 6, admixed to the residual gas withdrawn via conduit 13, which leaves the plant by way of reversing exchangers 1 and 1'.

According to the invention, product oxygen is withdrawn in the liquid phase from the low pressure column 3 via conduit 15 at a pressure, e.g., of 1.5 bars and vaporized in condenser-evaporator 4 at a pressure of, e.g., 2.4 bars before being withdrawn from the plant via conduit 16 by way of revex's 1 and 1'. Due to the fact that the condenser-evaporator is located at a higher level, the pressure in the oxygen vapor space is increased by the hydrostatic pressure of the feed conduit 15. If product oxygen is desired which is under an even higher pressure, than a liquid pump can be connected into the feed conduit 15 in the evaporation space of the condenser-evaporator 4 to provide an additional pressure increase. The amount of heat required for vaporization is supplied by the minor partial air stream branched off at point 7, this stream being further compressed, in accordance with the invention, in recompressor 5, to e.g., 7.4 bars and is cooled in reversing exchanger 1'. This partial air stream is condensed in the condenser-evaporator 4 against evaporating product oxygen and then introduced into the high pressure column 2. Due to the fact that the product oxygen is vaporized in indirect heat exchange contact with air, which is under a higher pressure as compared to the high pressure column, this product oxygen itself can also be obtained under a higher pressure.

Figure 2:
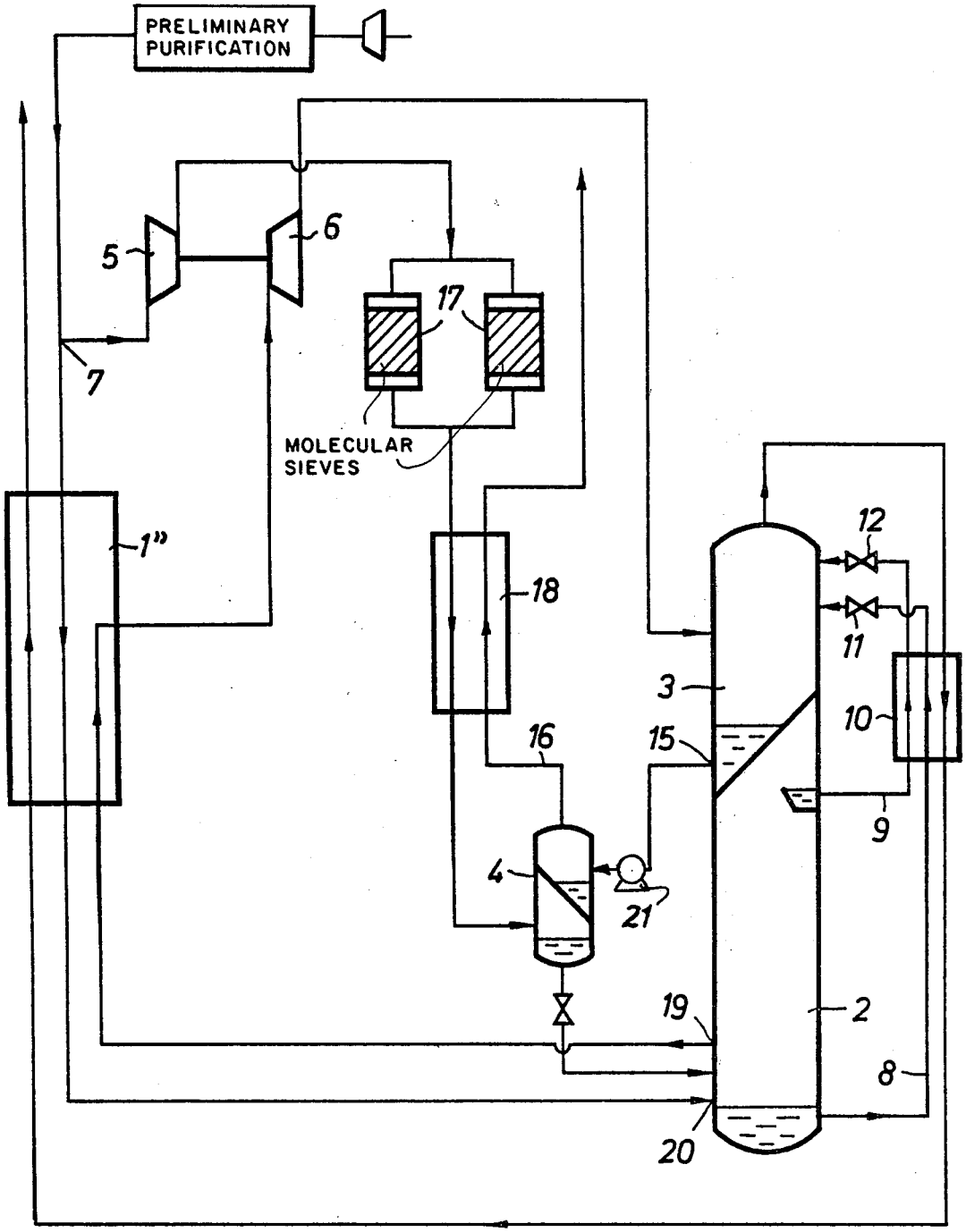
FIG. 2 is a schematic flowsheet of a system as illustrated in FIG. 1 with the preferred aspect of the invention wherein regenerators serve as the primary heat exchangers and with molecular sieves for cleaning a portion of the air. Air is utilized as the compensating stream.

The process scheme of FIG. 2 differs from that of FIG. 1 by the following items: A pair of regenerators 1" serves as the primary heat exchanger. The air, further compressed in recompressor 5 according to this invention, is purified in a molecular sieve system 17 before being cooled in heat exchange with product oxygen in heat exchanger 18. The nature of the molcular sieve is that it removes undesired impurities from the air, i.e. $H_2O$, $CO_2$, $C_2H_2$, $C_2H_6$, $C_3H_6$, $C_4H_8$, to an extent of 99.95%.

In comparison the preliminary purification removes $H_2O$, $CO_2$, $C_4H_8$ to an extent of 99.7%. These undesired impurities are deposited in liquid or solid form within the passages of the reversing heat exchanger as the air is passed over the cold surface. They are removed when the passages are switched on to low pressure waste service. The driving force to remove the solid contaminants from the heat exchanger surface comes from the difference in vapor pressure between the high pressure and low pressure streams.

Also, a pump 21 is provided for transferring and increasing the pressure of the oxygen product from the low pressure column to the condenser-evaporator.

At point 19, air is withdrawn from the high pressure column 2, preferably between the second and third plates thereof, and introduced into the cold portion of regenerator 1", withdrawn before the heat exchange process is terminated, and, after being engine-expanded in turbine 6, is introduced under pressure into the low pressure column.

The importance of using the present invention for the production of high pressure oxygen as compared to the conventional system (wherein the entire feed has to be compressed to the correct pressure, see M. Duckett, Process Engineering Dec. 1973 p. 76/81) is manifested by lower power consumption because the air compressor discharge pressure is lower (7.5 bars instead of 10 bars). In addition there are two further advantages:

1. By compression of the minor partial air stream in the brake blower of the expansion turbine, the energy released from the turbine is utilized more efficiently.

Normally this energy is fed by a brake generator into the electric net, but the efficiency of this power transmission is very low. Whereas the brake generator feeds effective power into the net, it also takes high reactive wattless power for its own excitation out of the net.

2. Because of the higher pressure of the oxygen which leaves the air separation unit a connected $O_2$-compressor can be obtained at a lower price, as the higher $O_2$-suction-pressure permits a smaller compression ratio. By this smaller ratio, at least one or several compressor stages can be omitted. The power requirement of the $O_2$-compressor is reduced accordingly.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the separation of oxygen having a pressure of 1.7 to 3.6 bars from air in a two-stage low-temperature rectification column, the steps comprising:

(a) subdividing preliminary purified and compressed air having a pressure of 5.8 to 7.8 bars absolute into a minor stream constituting 18–34% of the air and a major stream constituting the remainder of the air;

(b) further compressing said minor stream of air from a pressure of 5.8 to 7.8 bars to a pressure of 6.5 to 10 bars absolute wherein said minor stream is compressed incrementally by at least 0.7 bars;

(c) at least partially liquefying resultant further compressed air feed in a condenser-evaporator functionally separate and distinct from said two-stage low-temperature rectification column in indirect heat exchange contact with vaporizing liquid oxygen product maintained at about 0.4 to 2.0 bars pressure higher than the pressure in the sump of the low pressure column from which the liquid oxygen is obtained, said oxygen vapor having a pressure of 1.7 to 3.6 bars;

(d) passing resultant at least partially liquefied air into the high pressure stage of the rectification column;

(e) cooling the major stream of the air feed without further compressing;

(f) passing resultant cooled major stream of the air feed into the high pressure stage of the rectification column;

(g) withdrawing a gaseous stream acting as a compensating stream from said high pressure stage;

(h) partially warming said compensating stream in indirect heat exchange with said major stream of the air feed being cooled in step (e), and also warming said compensating stream in indirect heat exchange with resultant compressed minor stream of the air feed, the partially warming of said compensating stream being conducted in a heat exchanger distinct and independent from said condenser-evaporator of step (c), said compressed minor stream of air feed is first passed through said independent and distinct heat exchanger for warming said compensating stream before said compressed minor stream is passed into said condenser-evaporator of step (c), (i) expanding resultant partially warmed stream in a turbine; and (j) employing resultant mechanical energy directly from the turbine for said further recompressing of said subdivided minor stream of the feed air in a coupled brake blower.

2. A process according to claim 1, wherein a stream having substantially the same composition as air is utilized as the compensating stream, which stream is withdrawn from the lower part of the high pressure stage and, after the engine-expansion, is introduced under pressure into the low pressure stage of the rectification column.

3. A process according to claim 1, wherein a stream enriched in nitrogen is utilized as the compensating stream, which stream is withdrawn from the head of the high pressure stage and, after the engine-expansion, is warmed and is withdrawn from the plant.

4. A process according to claim 1, the further compressed minor portion of air feed being purified in a molecular sieve prior to being cooled, said cooling being conducted in an indirect heat exchanger.

5. A process according to claim 11, wherein said higher pressure in step (c) is maintained by a hydrostatic head of oxygen obtained by placing the condenser-evaporator below the level of the sump of the low pressure stage.

6. A process according to claim 11, wherein said higher pressure in step (c) is maintained by a pump for liquid oxygen.

7. A process according to claim 1, wherein the minor stream in step (b) is further compressed from 6.2 bars absolute to 7.2 to 8.0 bars absolute, the air being compressed incrementally 1.0 to 2.2 bars.

8. A process according to claim 7 wherein the pressure of the vaporizing oxygen in step (c) is 0.6 to 1.0 bars higher than in the sump of the low pressure column.

9. A process according to claim 8, wherein the partial liquefaction of further compressed air in step (c) is at least 70%.

10. A process according to claim 1 wherein the pressure of the vaporizing oxygen in step (c) is 0.6 to 1.0 bars higher than in the sump of the low pressure column.

11. A process according to claim 1, wherein the partial liquefaction of further compressed air in step (c) is at least 70%.

* * * * *